US012408810B1

(12) United States Patent
Zhang et al.

(10) Patent No.: US 12,408,810 B1
(45) Date of Patent: Sep. 9, 2025

(54) DISHWASHER WITH RESIDUE DISPOSAL DEVICE AND CONTROL METHOD THEREFOR

(71) Applicant: ZHEJIANG SENG SMART KITCHEN APPLIANCE CO., LTD, Zhejiang (CN)

(72) Inventors: Jianjun Zhang, Zhejiang (CN); Lingchao Wang, Zhejiang (CN); Xiao Zheng, Zhejiang (CN); Xingbo Chen, Zhejiang (CN); Dezhong Fan, Zhejiang (CN)

(73) Assignee: ZHEJIANG SENG SMART KITCHEN APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 18/659,749

(22) Filed: May 9, 2024

(30) Foreign Application Priority Data

Mar. 5, 2024 (CN) ..... 202410245107.6

(51) Int. Cl.
*A47L 15/42* (2006.01)
*A47L 15/00* (2006.01)

(52) U.S. Cl.
CPC ..... *A47L 15/4227* (2013.01); *A47L 15/0028* (2013.01); *A47L 15/0031* (2013.01);
(Continued)

(58) Field of Classification Search
CPC ..... E03D 9/10; E03C 1/2665; A47J 43/0722; B02C 18/0092
See application file for complete search history.

(56) References Cited

U.S. PATENT DOCUMENTS 4,448,359 A * 5/1984 Meyers ..... A47L 15/4227 241/257.1
5,320,120 A * 6/1994 Hoffman ..... A47L 15/4225 134/104.1

(Continued)

FOREIGN PATENT DOCUMENTS

CN 107866318 A * 4/2018 ..... A47L 15/4208
CN 107981813 A * 5/2018 ..... A47L 15/14

(Continued)

OTHER PUBLICATIONS

Communication dated Oct. 31, 2024 from the State Intellectual Property Office of People's Republic of China in application No. 202410245107.6.

(Continued)

*Primary Examiner* — Omair Chaudhri
(74) *Attorney, Agent, or Firm* — Sughrue Mion, PLLC

(57) ABSTRACT

The invention provides a dishwasher with a residue disposal device, comprising a housing and a liner, the liner is arranged in the housing, a spray assembly and a water collection assembly are arranged in the liner, the spray assembly is connected to the water collection assembly, the water collection assembly is provided with a drain hose, a residue disposal device is arranged on the drain hose and connected to the water collection assembly by means of a return pipe, and a three valve is arranged at a joint of the return pipe and the drain hose. The requirement for disposing residues in sewage in a water cup can be met, that is, a closed water path from the water collection assembly to the residue disposal device, the drain hose and the water collection assembly is formed, and under the action of a negative pressure generated by the residue disposal device arranged on the closed water path, water flows unidirectionally to wash the water cup, thus reducing the quantity of residues in the water cup. The requirement for discharging (Continued)

residues can be met, that is, the residue disposal device can replace a drain pump to form a discharge water path from the water collection assembly to the residue disposal device and the drain hose to promote processed food residues to be discharged from the drain hose. The whole process is implemented automatically without manual intervention.

6 Claims, 6 Drawing Sheets

(52) U.S. Cl.
CPC ..... *A47L 15/4204* (2013.01); *A47L 15/4223* (2013.01); *A47L 15/4278* (2013.01); *A47L 2501/02* (2013.01); *A47L 2501/03* (2013.01); *A47L 2501/05* (2013.01)

(56) References Cited

U.S. PATENT DOCUMENTS

| | | | | | |
|---|---|---|---|---|---|
| 5,566,696 | A * | 10/1996 | Dries | A47L 15/4202 | 277/420 |
| 6,454,872 | B1 * | 9/2002 | Miller | A47L 15/4227 | 134/201 |
| 2005/0263174 | A1 * | 12/2005 | Yoon | A47L 15/4202 | 134/179 |
| 2006/0005863 | A1 * | 1/2006 | Gurubatham | A47L 15/4227 | 134/104.1 |
| 2006/0042657 | A1 * | 3/2006 | Welch | F04D 29/426 | 134/186 |
| 2012/0145203 | A1 * | 6/2012 | Watson | A47L 15/4227 | 134/110 |
| 2018/0111066 | A1 * | 4/2018 | Boyer | A47L 15/23 | |
| 2019/0059686 | A1 * | 2/2019 | Roy | A47L 15/001 | |
| 2024/0164617 | A1 * | 5/2024 | Unterberger | D06F 39/30 | |

FOREIGN PATENT DOCUMENTS

| | | | | | |
|---|---|---|---|---|---|
| CN | 108309189 | A | * | 7/2018 | A47L 15/14 |
| CN | 108852220 | A | * | 11/2018 | A47L 15/0086 |
| CN | 113143157 | A | * | 7/2021 | |
| CN | 113647880 | A | * | 11/2021 | |
| CN | 114468936 | A | * | 5/2022 | A47L 15/4217 |
| CN | 216984843 | U | * | 7/2022 | |
| CN | 112337600 | B | * | 8/2024 | B02C 18/0092 |
| GB | 933869 | A | * | 8/1963 | |

OTHER PUBLICATIONS

Communication dated Jul. 18, 2024 from the State Intellectual Property Office of People's Republic of China in application No. 202410245107.6.

Communication dated Jan. 2, 2025 from the State Intellectual Property Office of People's Republic of China in application No. 202410245107.6.

* cited by examiner

DISHWASHER WITH RESIDUE DISPOSAL DEVICE AND CONTROL METHOD THEREFOR

BACKGROUND OF THE INVENTION

1. Technical Field

The invention belongs to the technical field of dishwashers, and particularly relates to a dishwasher with a residue disposal device and a control method therefor.

2. Description of Related Art

Dishwashers are typically provided with a water cup, which is located at the bottom of the dishwashers and is used for collecting and discharging sewage produced during the washing process. A drain pump is generally mounted on the side face or bottom of the dishwashers and connected to the water cup by means of a pipe to pump washing wastewater from the dishwashers into a sewer. A residue filter basket is often arranged in the water cup to filter and separate large-sized residues out of the sewage to prevent blockage.

In practice, existing dishwashers have the following problems:

1. The drain pump of the dishwasher generally pumps large-sized soft residues and sewage produced during the washing process out of the residue filter backet and discharges the sewage from the dishwasher into the sewer by means of a drain line, thus weakening the effect of the residue filter backet and possibly leading to blockage of the drain line.

2. Food residues in the residue filter basket need to be manually removed by users after washing.

3. In addition, food residues are disposed at present by means of a cutter assembly placed in the water cup (for example, Chinese Patent Publication No. CN217696501U, entitled Food Residue Disposal Device and Dishwasher), and when the cutter assembly cuts food, the food residues will splash into an inner cavity of the dishwasher, leading to secondary pollution to the inner cavity of the dishwasher. In view of this, the invention provides a dishwasher with a residue disposal device and a control method therefor.

BRIEF SUMMARY OF THE INVENTION

The objective of the invention is to solve the abovementioned technical problems existing in the prior art by providing a dishwasher with a residue disposal device, wherein the residue disposal device forms a discharge water path and a closed water path together with a water cup; the closed water path promotes food residues to flow in the water cup, thus guaranteeing that the food residues flow into the residue disposal device to be disposed separately; after being disposed, the food residues are discharged by the discharge water path, thus avoiding pipe blockage. The whole process is implemented automatically without manual intervention.

To solve the abovementioned technical problems, the invention adopts the following technical solution:

A dishwasher with a residue disposal device comprises a housing and a liner, wherein the liner is arranged in the housing, a spray assembly and a water collection assembly are arranged in the liner, the spray assembly is connected to the water collection assembly, the water collection assembly is provided with a drain hose, a residue disposal device is arranged on the drain hose and used for pumping and disposing residues, a three-way is arranged on a hose body of the drain hose and connected to the water collection assembly by means of a return pipe, and a valve port of the three-way valve is controlled to form a closed water path from the water collection assembly to the residue disposal device, the drain hose and the water collection assembly or form a discharge water path from the water collection assembly to the residue disposal device and the drain hose.

Further, the drain hose and the return pipe are connected to two sides of a bottom of the water collection assembly, the bottom of the water collection assembly is oblique, and an end, located on the drain hose, of the bottom of the water collection assembly is lower than an end, located on the return pipe, of the bottom of the water collection assembly.

Further, the residue disposal device comprises a shell and a rotating motor, an upper cavity and a lower cavity are arranged in the shell, the upper cavity is provided with a water inlet, the lower cavity is provided with a water outlet, a grinding assembly is arranged in the upper cavity, a drain impeller is arranged in the lower cavity, an output end of the rotating motor is connected to the grinding assembly and the drain impeller, the grinding assembly is used for cutting and grinding food residues, and the drain impeller is used for stirring a water flow.

Further, the grinding assembly comprises a blade assembly and a filter screen plate, the blade assembly is arranged on the filter screen plate and fixed to the output end of the rotating motor, a vertical circular wall plate is arranged on the filter screen plate and configured as a grid structure, and the blade assembly fits the filter screen plate and the circular wall plate to grind the food residues.

Further, a center of the drain impeller is fixed to the output end of the rotating motor, and a plurality of arc-shaped blades are arranged on an upper surface of the drain impeller.

Further, the blade assembly comprises L-shaped blades and cutting blades, sawteeth are arranged on edges of the L-shaped blades, each L-shaped blade comprises first blade sections and a second blade section, the second blade section fits the filter screen plate, the first blade sections and the second blade section are connected with a right angle being formed therebetween such that the first blade sections are parallel to a circular side wall, each cutting edge comprises third blade sections and a fourth blade section, and the third blade sections and the fourth blade section are connected with an angle greater than 90° being formed therebetween.

Further, a guide cavity is formed in the shell, and the guide cavity is located between the upper cavity and the lower cavity and shaped like a funnel which becomes smaller gradually from top to bottom.

Further, the water collection assembly is a water cup, a circular filter screen is arranged in the water cup and used for filtering cleaning water entering a spray pipe, and a vent is formed in a bottom of the circular filter screen and faces a bottom of the water cup.

A control method for the dishwasher with a residue disposal device comprises a cleaning stage and a draining stage, and the draining stage comprises draining A without residue disposal or draining B with residue disposal; the draining A comprises the following steps: closing the return pipe by controlling the valve port of the three-way valve, connecting water outlet ports of a residue disposal pump and the drain hose, and generating a negative pressure by the residue disposal pump to apply a suction force to mixed liquor with food residues in the water cup, such that the mixed liquor is discharged via the water outlet port of the drain hose; the draining B comprises the following steps: closing the water outlet port of the drain hose by controlling the valve port of the three-way valve, forming a circulating water path between the residue disposal pump and the water cup by means of the drain hose and the return pipe, starting the residue disposal device to generate a negative pressure to promote a water flow in the circulating water path, driving food residues in the water cup to enter the drain hose to be ground under the action of the circulating water flow and the negative pressure of the residue disposal device, repeating the process multiple times until residue particles in the residue disposal pump pass through holes in a circular filter screen plate, then closing the return pipe by controlling the valve port of the three-way valve, and connecting the water outlet ports of the residue disposal pump and the drain hose to allow the mixed liquor to be discharged from the water outlet port of the drain hose by means of the residue disposal pump.

Further, the water collection assembly is arranged at a bottom of the liner, the spray assembly comprises an upper spray arm and a lower spray arm, the upper spray arm is arranged at a top of the liner, the lower spray arm is arranged at the bottom of the liner, the water collection assembly is connected to a washing pump and a shunt valve by means of pipes, and branched water pipes are arranged on the shunt valve and connected to the upper spray arm and the lower spray arm respectively; the cleaning stage comprises up-down cleaning and separate cleaning, the up-down cleaning comprises diagonal cleaning by the upper spray arm and the lower spray arm and non-diagonal cleaning by the upper spray arm and the lower spray arm; during the up-down cleaning, the water cup is connected to the upper spray arm and the lower spray arm by controlling a valve port of the shunt valve, the washing pump is started, cleaning water is delivered to the upper spray arm and the lower spray arm by means of the shunt valve, and the upper spray arm and the lower spray arm wash an interior of the liner; during the separate cleaning which is set after the up-down cleaning, the water cup is connected to a water path of the upper spray arm first by controlling the valve port of the shunt valve, then the washing pump is started, cleaning water is delivered to the upper spray arm by means of the shunt valve, the upper spray arm rotates to wash a side wall of the liner; then, the water cup is connected to a water path of the lower spray arm by means of the shunt valve, the washing pump is started, cleaning water is delivered to the lower spray arm by means of the shunt valve, a spray nozzle of the lower spray arm faces the bottom of the liner, and the lower spray arm rotates to wash residues from the bottom of the liner into the water collection assembly.

By adopting the above technical solution, the invention has the following beneficial effects:

The dishwasher provided by the invention comprises a housing and a liner, the liner is arranged in the housing, a spray assembly and a water collection assembly are arranged in the liner, the spray assembly is connected to the water collection assembly, the water collection assembly is provided with a drain hose, a residue disposal device is arranged on the drain hose and connected to the water collection assembly by means of a return pipe, and a three valve is arranged at a joint of the return pipe and the drain hose. The requirement for disposing residues in sewage in a water cup can be met, that is, a closed water path from the water collection assembly to the residue disposal device, the drain hose and the water collection assembly is formed, and under the action of a negative pressure generated by the residue disposal device arranged on the closed water path, water flows unidirectionally to wash the water cup, thus reducing the quantity of residues in the water cup. The requirement for discharging residues can be met, that is, the residue disposal device can replace a drain pump to form a discharge water path from the water collection assembly to the residue disposal device and the drain hose to promote processed food residues to be discharged from the drain hose. The whole process is implemented automatically without manual intervention.

BRIEF DESCRIPTION OF THE SEVERAL VIEWS OF THE DRAWINGS

The invention is further described below in conjunction with accompanying drawings.

In the FIGS.: 1, liner; 2, water cup; 3, circular filter screen; 4, residue disposal device; 5, drain hose; 6, three-way valve; 7, washing pump; 8, shunt valve; 9, lower spray arm; 10, upper spray arm; 11, water inlet valve; 12, return pipe; 13, rotating motor; 14, vent; 15, arc-shaped blade; 16, grinding assembly; 17, upper cavity; 18, guide cavity; 19, lower cavity; 20, filter screen plate; 21, circular wall plate; 22, blade assembly; 23, first blade section; 24, second blade section; 25, L-shaped blade; 26, sawtooth; 27, third blade section; 28, fourth blade section; 29, cutting blade; 30, drain impeller; 31, water inlet; 32, water outlet.

DETAILED DESCRIPTION OF THE INVENTION

Figure 1:
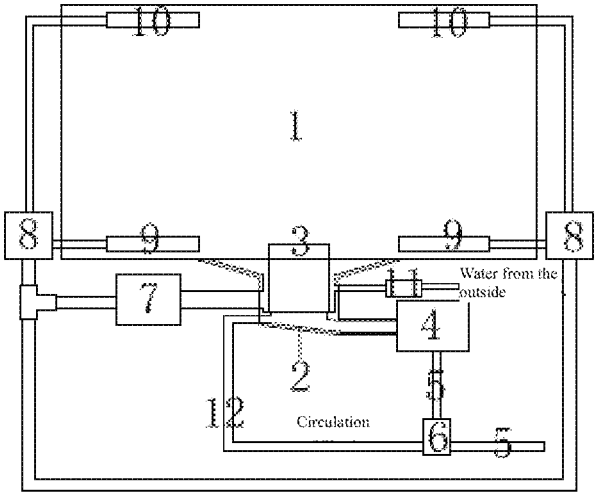
FIG. 1 is a structural principle diagram according to the invention.
Figure 2:
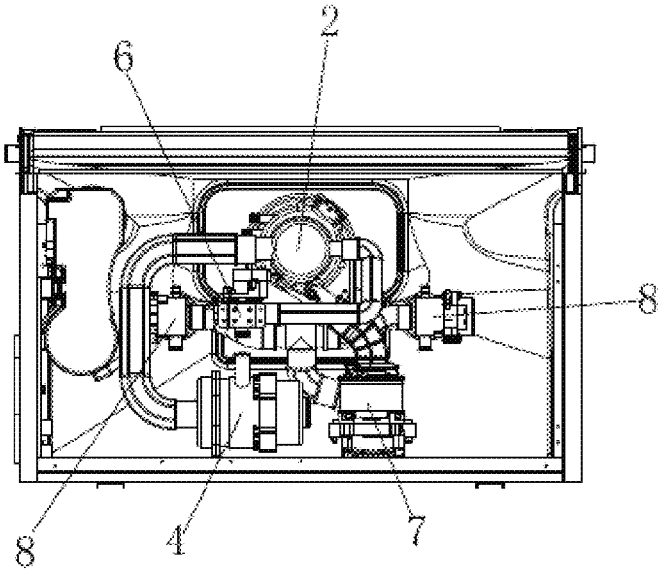
FIG. 2 is a bottom view according to the invention (without a bottom shell)
Figure 3:
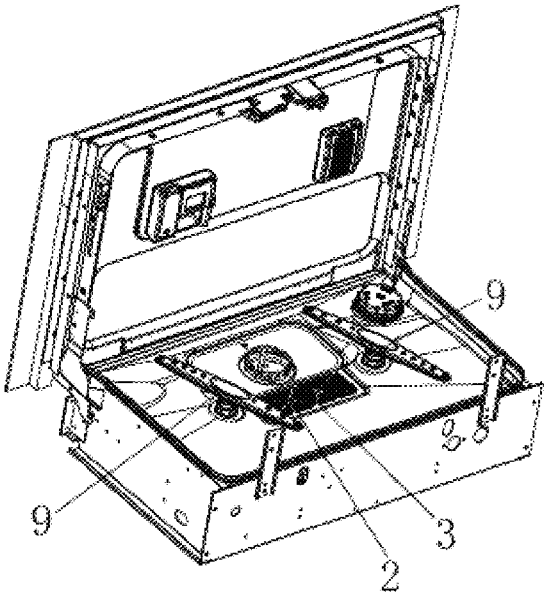
FIG. 3 is a schematic structural diagram of the bottom of a liner according to the invention.
Figure 4:
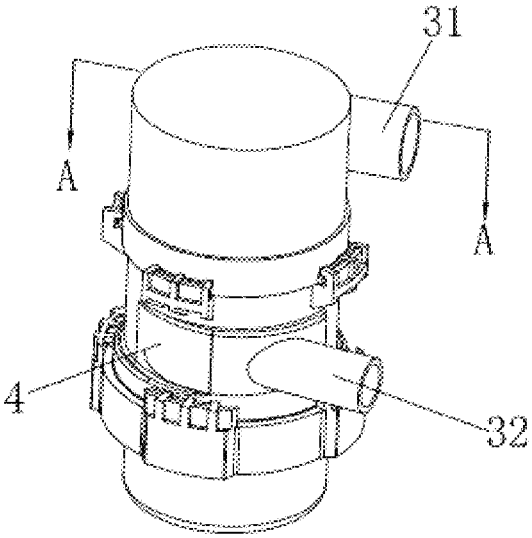
FIG. 4 is a schematic structural diagram of a residue disposal pump according to the invention.
Figure 5:
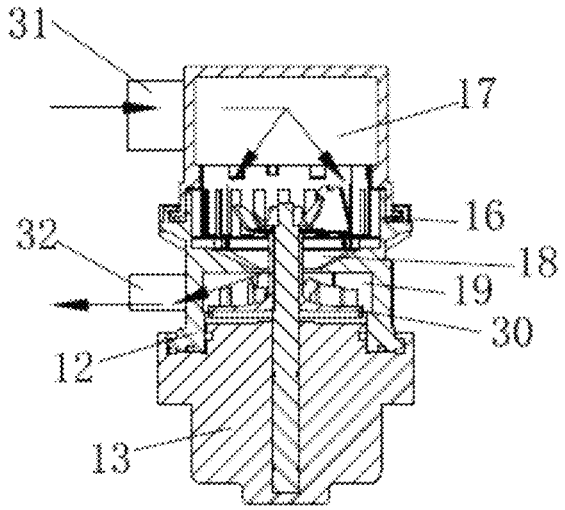
FIG. 5 is a sectional view along A-A in FIG. 4.
Figure 6:
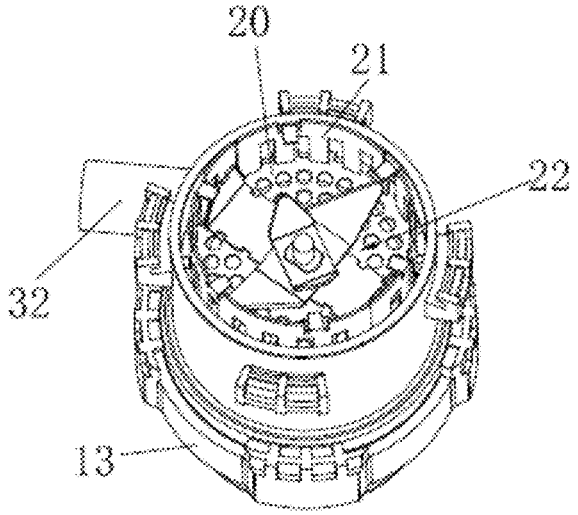
FIG. 6 is an internal structural diagram of an upper cavity according to the invention.
Figure 7:
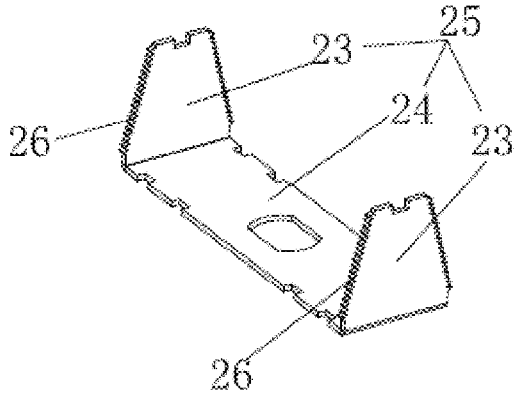
FIG. 7 is a schematic structural diagram of an L-shaped blade according to the invention.
Figure 8:
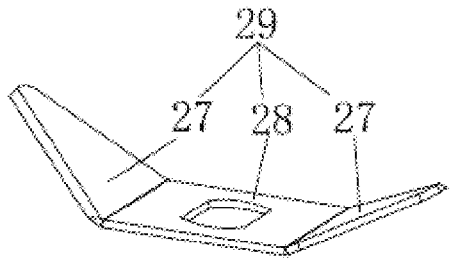
FIG. 8 is a schematic structural diagram of a cutting blade according to the invention.
Figure 9:
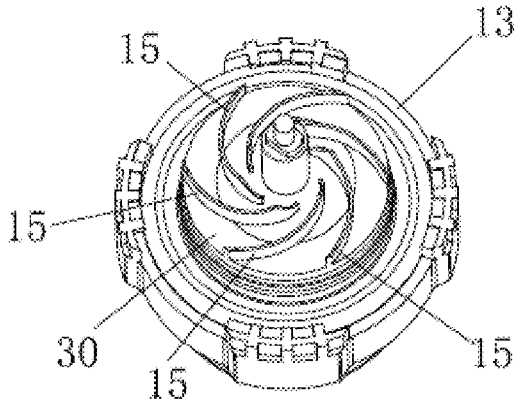
FIG. 9 is a schematic structural diagram of a drain impeller and a rotating motor according to the invention.
Figure 10:
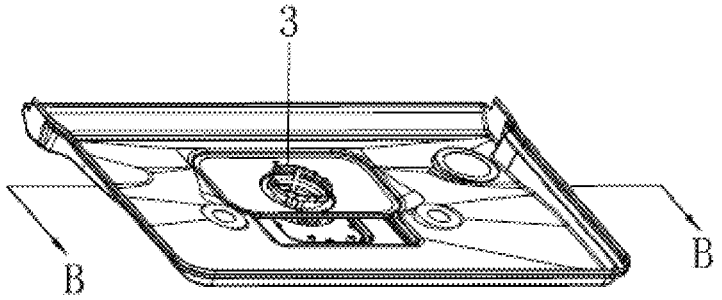
FIG. 10 is a schematic structural diagram of the bottom of the liner and a water collection assembly according to the invention.
Figure 11:
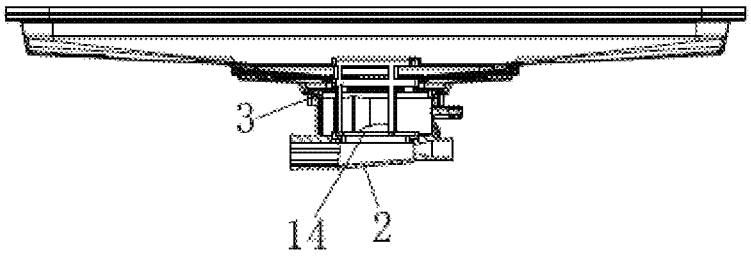
FIG. 11 is a sectional view along B-B in FIG. 10.
Figure 12:
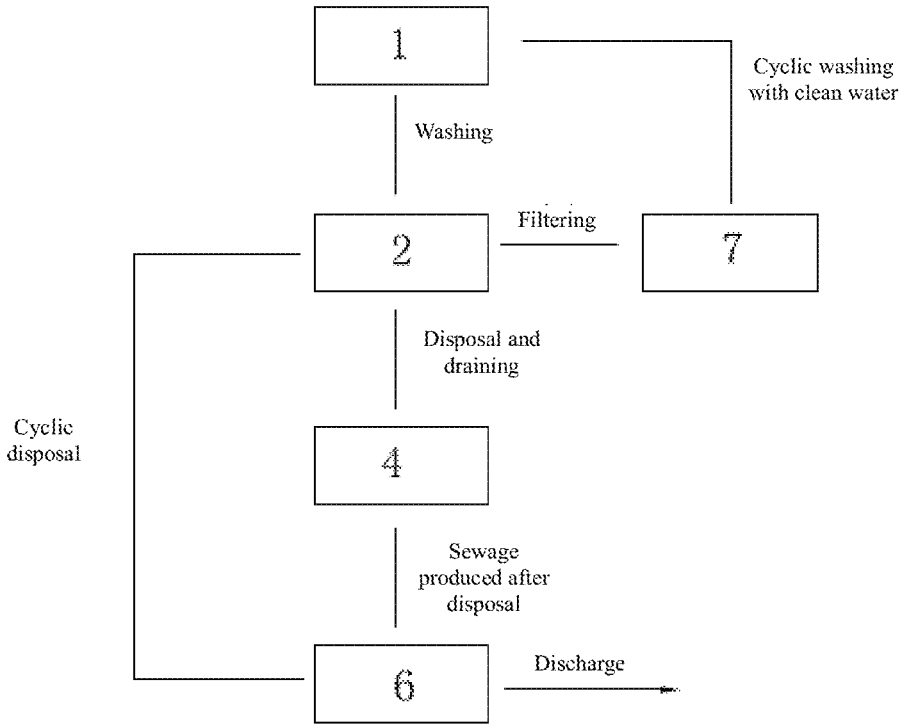
FIG. 12 is a control flow diagram according to the invention.

As shown in FIG. 1 to FIG. 12, the invention provides a dishwasher with a residue disposal device, comprising a housing and a liner 1, wherein the liner 1 is arranged in the housing, a spray assembly and a water collection assembly are arranged in the liner 1, the spray assembly is connected to the water collection assembly, the water collection assembly is provided with a drain hose 5, a residue disposal device 4 is arranged on the drain hose 5 and used for pumping and disposing residues, a three-way 6 is arranged on a hose body of the drain hose 5 and connected to the water collection assembly by means of a return pipe 12, and a valve port of the three-way valve 6 is controlled to form a closed water path from the water collection assembly to the residue disposal device 4, the drain hose 5 and the water collection assembly or form a discharge water path from the water collection assembly to the residue disposal device 4 and the drain hose 5. In a case where the closed water path is formed, the residue disposal device has a flow promotion effect to promote the water flow in the closed water path to wash a water cup to prevent food residues from being adhered to the bottom surface of the water cup 2, and the food residues flow into the residue disposal device to be disposed separately and will not cause secondary pollution to the liner 1 of the dishwasher. In a case where the discharge water path is formed, the residue disposal device functions as a drain pump to promote disposed food residues to be discharged, thus avoiding blockage of the drain hose 5. In addition, the whole process is implemented automatically without manual intervention.

The drain hose 5 and the return pipe 12 are connected to two sides of the bottom of the water collection assembly, the bottom of the water collection assembly is oblique, and an end, located on the drain hose 5, of the bottom of the water collection assembly is lower than an end, located on the return pipe 12, of the bottom of the water collection assembly. In this way, the water flow is guided and accelerated, thus improving the washing force applied to the bottom of the water collection assembly.

The residue disposal device 4 comprises a shell and a rotating motor 13, wherein a guide cavity 18, an upper cavity 17 and a lower cavity 19 are arranged in the shell, the upper cavity 17 is provided with a water inlet 31, the lower cavity 19 is provided with a water outlet 32, a grinding assembly 16 is arranged in the upper cavity 17, a drain impeller 33 is arranged in the lower cavity 19, the grinding assembly 16 comprises a blade assembly 22 and a filter screen plate 20, the blade assembly 22 is arranged on the filter screen plate 20 and fixed to an output end of the rotating motor 13, a vertical circular wall plate 21 is arranged on the filter screen plate 20 and is configured as a grid structure, and the blade assembly 22 fits the filter screen plate 20 and the circular wall plate 21 to grind food residues. The center of the drain impeller 30 is connected to the output end of the rotating motor 13, and a plurality of arc-shaped blades 15 are arranged on an upper surface of the drain impeller 30. The drain impeller 30 rotates to stir the water flow to generate a negative pressure so as to promote water to flow from the upper cavity 17 to the lower cavity 19. The guide cavity 18 is located between the upper cavity 17 and the lower cavity 19 and is shaped like a funnel which becomes smaller gradually from top to bottom, such that sewage can be guided to flow into the lower cavity 19 and a shelter can be formed above the drain impeller 30 to prevent sewage from splashing upwards, thus improving draining efficiency. The blade assembly 22 comprises L-shaped blades 25 and cutting blades 29. Sawteeth 26 are arranged on edges of the L-shaped blades 25. Each L-shaped blade 25 comprises first blade sections 23 and a second blade section 24. Each cutting blade 29 comprises third blade sections 27 and a fourth blade section 28. The center of the second blade section 24 and the center of the fourth blade section 28 are connected to the output end of the rotating motor 13. The third blade sections 27 and the fourth blade section 28 are connected with an obtuse angle greater than 90° being formed therebetween, such that food residues can be splashed towards the circular wall plate 21. The first blade sections 23 and the second blade section 24 are connected with a right angle being formed therebetween, such that the first blade sections 23 are parallel to the circular side wall and can work together with the circular side wall to crush hard food residues (such as fishbones and shrimp shells), and the second blade section 24 can work together with the filter screen plate 20 to grind the food residues.

The water collection assembly is a water cup 2, a circular filter screen 3 is arranged in the water cup 2 and used for filtering cleaning water entering a spray pipe, and a vent 14 is formed in the bottom of the circular filter screen 3 and faces the bottom of the water cup 2. A residue filter backet in the water cup 2 is eliminated, the water cup 2 does not need to be manually cleaned, and filter residues with a diameter greater than that of filter holes of the circular filter screen 3 directly reach the bottom of the water cup 2 via the vent 14 to be disposed by the residue disposal device 4 or are directly pumped into the residue disposal device 4 to be disposed. The cleaning convenience is improved by automatic cleaning.

The invention further provides a control method for the dishwasher with a residue disposal device. The water cup 2 is connected to a water inlet pipe by means of a water inlet valve 11. A spray assembly comprises upper spray arms 10 and lower spray arms 9, the upper spray arms 10 are arranged at the top of the liner 1, the lower spray arms 9 are arranged at the bottom of the liner 1, the water collection assembly is connected to a washing pump 7 and shunt valves 8 by means of pipes, and branched water pipes are arranged on the shunt valves 8 and connected to the upper spray arms 10 and the lower spray arms 9 respectively; the upper spray arms 10 and the lower spray arms 9 perform diagonally or non-diagonally, a main control board issues a water inlet spray instruction A, the water inlet valve 11, the shunt valves 8 (valve ports of the shunt valves 8 are controlled to connect water paths of the water cup 2 and the lower spray arms 9) and the washing pump 7 receive the water inlet spray instruction A to be started and feed signals back to the main control board, cleaning water is delivered to the upper spray arms 10 and the lower spray arms 9 by means of the shunt valves 8, the upper spray arms 10 and the lower spray arms 9 rotate to wash the interior of the liner 1. Similarly, the upper spray arms 10 and the lower spray arms 9 can also clean the interior of the liner 1 separately, that is, the inner wall of the liner 1 is cleaned first, then the bottom of the liner 1 is cleaned, and when the lower spray arms 9 washes residues at the bottom of the liner 1, cleaning water sprayed by the upper spray arms 10 is also washed into the water collection assembly.

At a draining stage, a cleaning mode of the dishwasher in specific Embodiment 1 can be selected, a water outlet port of the three-way valve 6 is initially closed, and the residue disposal pump and the water collection assembly are connected. During draining A without residue disposal, the main control board issues a draining instruction A, a driver board of the residue disposal device receives the draining instruction A and feeds a signal back to the main control board, at this moment, the three-way valve 6 operates for 12 s (the return pipe 12 is closed, and water outlet ports of the residue disposal pump and the drain hose 5 are connected), then the residue disposal device 4 is started to operate for 15 s, then stops for 5 s, then operates for 15 s and then is shut down, and finally, the three-way valve 6 operates for 12 s (the water outlet port is closed, and the residue disposal pump and the water collection assembly are connected); at this moment, an end instruction is uploaded, the main control board feeds a signal back to the driver board when receiving the end instruction, and the dishwasher enters the next washing stage.

At the draining stage, a powerful cleaning mode of the dishwasher in specific Embodiment 2 can be selected, the water outlet port of the three-way valve 6 is initially closed, and the residue disposal pump and the water collection assembly are connected. During draining II with residue disposal, the main control board issues a draining instruction C, the driver board of the residue disposal device receives the draining instruction C and feeds a signal back to the main control board, at this moment, the motor is started to operate for 120 s, the three-way valve 6 starts to operate at the 60 s (the return pipe 12 is closed, and the water outlet ports of the residue disposal pump and the drain hose 5 are connected), the motor stops at the 120 s, and finally, the three-way valve 6 operates for about 12 s (the water outlet port is closed, and the residue disposal pump and the water collection assembly are connected); at this moment, an end instruction is uploaded, the main control board feeds a signal back to the driver board when receiving the end instruction, and the dishwasher enters the next cleaning stage.

The above embodiments are merely specific embodiments of the invention, and the technical features of the invention are not limited to the above embodiments. Any simple variations, equivalent substitutions or modifications made based on the invention to solve basically the same technical problems and fulfill basically the same technical effects should also fall within the protection scope of the invention.

What is claimed is:

1. A dishwasher with a residue disposal device, comprising a housing and a liner, the liner being arranged in the housing, a spray assembly and a water collection assembly being arranged in the liner, the spray assembly being connected to the water collection assembly by means of a spray pipe, wherein the water collection assembly is provided with a drain hose, a residue disposal device is arranged on the drain hose and used for pumping and disposing residues, a three-way valve is arranged on a hose body of the drain hose and connected to the water collection assembly by means of a return pipe, and the three-way valve is controlled to form a closed water path from the water collection assembly to the residue disposal device in a first state, and is controlled to form a discharge water path from the water collection assembly to the residue disposal device and the drain hose in a second state;

in a case where the closed water path is formed, the residue disposal device has a flow promotion effect to promote water flow in the closed water path to wash a water cup, in a case where the discharge water path is formed, the residue disposal device functions as a drain pump to promote disposed food residues to be discharged, the drain hose and the return pipe are connected to two sides of a bottom of the water collection assembly, the bottom of the water collection assembly is oblique, and an end, located at the drain hose, of the bottom of the water collection assembly is lower than an end, located at the return pipe, of the bottom of the water collection assembly, the residue disposal device comprises a shell and a rotating motor, an upper cavity and a lower cavity are arranged in the shell, the upper cavity is provided with a water inlet, the lower cavity is provided with a water outlet, a grinding assembly is arranged in the upper cavity, a drain impeller is arranged in the lower cavity, an output end of the rotating motor is connected to the grinding assembly and the drain impeller, the grinding assembly is used for cutting and grinding food residues, and the drain impeller is used for stirring a water flow, the grinding assembly comprises a blade assembly and a filter screen plate, the blade assembly is arranged on the filter screen plate and fixed to the output end of the rotating motor, a vertical circular wall plate is arranged on the filter screen plate, and the blade assembly fits the filter screen plate and the circular wall plate to grind the food residues, the blade assembly comprises L-shaped blades and cutting blades, sawteeth are arranged on edges of the L-shaped blades, each said L-shaped blade comprises first blade sections and a second blade section, the second blade section fits the filter screen plate, the first blade sections and the second blade section are connected with a right angle being formed therebetween such that the first blade sections are parallel to a circular side wall, each said cutting edge comprises third blade sections and a fourth blade section, and the third blade sections and the fourth blade section are connected with an angle greater than 90° being formed therebetween.

2. The dishwasher with a residue disposal device according to claim 1, wherein a center of the drain impeller is fixed to the output end of the rotating motor, and a plurality of arc-shaped blades are arranged on an upper surface of the drain impeller.

3. The dishwasher with a residue disposal device according to claim 2, wherein a guide cavity is formed in the shell, and the guide cavity is located between the upper cavity and the lower cavity and shaped like a funnel which becomes smaller gradually from top to bottom.

4. The dishwasher with a residue disposal device according to claim 1, wherein a circular filter screen is arranged in the water cup and used for filtering cleaning water entering the spray pipe, and a vent is formed in a bottom of the circular filter screen and faces a bottom of the water cup.

5. A control method for the dishwasher with a residue disposal device according to claim 4, wherein the method comprises a cleaning stage and a draining stage, and the draining stage comprises (i) draining without residue disposal or (ii) draining with residue disposal;

the draining without residue disposal comprises the following steps: closing the return pipe by controlling the three-way valve, connecting water outlet ports of a residue disposal pump and the drain hose, and generating a negative pressure by the residue disposal pump to apply a suction force to mixed liquor with food residues in the water cup, such that the mixed liquor is discharged via the water outlet port of the drain hose;

the draining with residue disposal B-comprises the following steps: closing the water outlet port of the drain hose by controlling the three-way valve, forming a circulating water path between the residue disposal pump and the water cup by means of the drain hose and the return pipe, starting the residue disposal device to generate a negative pressure to promote a water flow in the circulating water path, driving food residues in the water cup to enter the drain hose to be ground under the action of the circulating water flow and the negative pressure of the residue disposal device, repeating the process multiple times until residue particles in the residue disposal pump pass through holes in a circular filter screen plate, then closing the return pipe by controlling the three-way valve, and connecting the water outlet ports of the residue disposal pump and the drain hose to allow the mixed liquor to be discharged from the water outlet port of the drain hose by means of the residue disposal pump.

6. The control method for the dishwasher with a residue disposal device according to claim 5, wherein the water collection assembly is arranged at a bottom of the liner, the spray assembly comprises an upper spray arm and a lower spray arm, the upper spray arm is arranged at a top of the liner, the lower spray arm is arranged at the bottom of the liner, the water collection assembly is connected to a washing pump and a shunt valve by means of pipes of the spray pipe, and branched water pipes of the spray pipe are arranged on the shunt valve and connected to the upper spray arm and the lower spray arm respectively;

the cleaning stage comprises up-down cleaning and separate cleaning, during the up-down cleaning, the water cup is connected to the upper spray arm and the lower spray arm by controlling the shunt valve, the washing pump is started, cleaning water is delivered to the upper spray arm and the lower spray arm by means of the shunt valve, and the upper spray arm and the lower spray arm wash an interior of the liner;

during the separate cleaning which is set after the up-down cleaning, the water cup is connected to a water path of the upper spray arm first by controlling the shunt valve, then the washing pump is started, cleaning water is delivered to the upper spray arm by means of the shunt valve, the upper spray arm rotates to wash a side wall of the liner; then, the water cup is connected to a water path of the lower spray arm by means of the shunt valve, the washing pump is started, cleaning water is delivered to the lower spray arm by means of the shunt valve, a spray nozzle of the lower spray arm faces the bottom of the liner, and the lower spray arm rotates to wash residues from the bottom of the liner into the water collection assembly.

* * * * *